United States Patent [19]

Leicht

[11] Patent Number: 4,631,880

[45] Date of Patent: Dec. 30, 1986

[54] ADJUSTABLE STAIRCASES

[76] Inventor: Charles L. Leicht, 384 South St., Toowoomba, Queensland, Australia, 4350

[21] Appl. No.: 695,392

[22] Filed: Jan. 28, 1985

[51] Int. Cl.[4] ..... E04F 11/00

[52] U.S. Cl. ..... 52/105; 52/183; 52/191; 182/228

[58] Field of Search ..... 52/183, 191, 105, 182, 52/633; 182/228, 194, 97; 248/242

[56] References Cited

U.S. PATENT DOCUMENTS

| | | | |
|---|---|---|---|
| 1,385,209 | 7/1921 | Hall | 52/191 |
| 3,299,590 | 1/1967 | Carter | 182/97 |
| 3,565,210 | 2/1971 | Evans | 52/633 |
| 4,148,164 | 4/1979 | Humphrey | 52/105 |

FOREIGN PATENT DOCUMENTS

| | | | |
|---|---|---|---|
| 202493 | 7/1956 | Australia | 52/633 |
| 179411 | 8/1954 | Austria | 52/633 |
| 2309685 | 11/1976 | France | 52/191 |

*Primary Examiner*—William F. Pate, III
*Assistant Examiner*—Caroline Dennison
*Attorney, Agent, or Firm*—Christie, Parker & Hale

[57] ABSTRACT

An adjustable staircase assembly comprises a pair of channel section stringer members having spaced tread support pivots adjacent their lower edges and tread locating apertures adjacent their upper edges, the tread locating apertures being spaced along arcs each having its origin at the tread support pivot axis. After the stringers are attached to a structure, the tread supports are pivoted to a horizontal position and a tab on each tread support is located in a suitable locating aperture in the sloping stringer such that the tread support is horizontal.

5 Claims, 5 Drawing Figures

ADJUSTABLE STAIRCASES

Figures 1, 4:
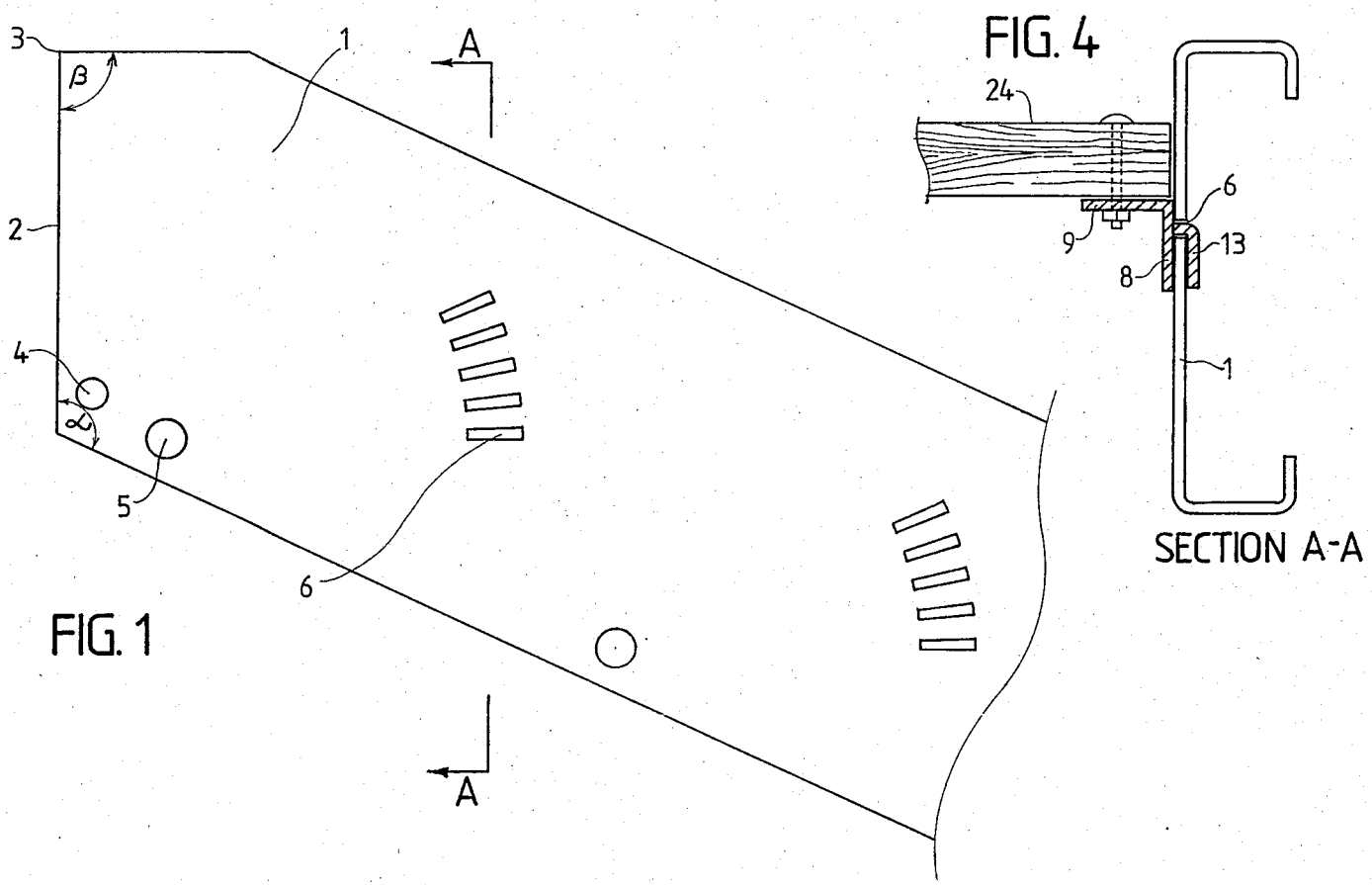

This invention is concerned with an adjustable staircase assembly adaptable to suit a variety of inclinations depending on vertical and/or horizontal dimensional constraints. The staircase assembly is also adjustable to suit a predetermined step rise selected from a conventional range.

Until recently, prior art staircases have been individually constructed to suit a particular environment. Often there are constraints on vertical height or horizontal distance available and these constraints in turn may affect or limit the choice of step rise. Accordingly, it has not been possible to mass produce a staircase assembly adaptable to a variety of dimensional variations.

A number of adjustable staircase assemblies have been proposed to overcome these problems and enable the mass production of staircase assemblies. These assemblies are comprised of steel, aluminium, timber or combinations thereof. The main disadvantage of prior art adjustable staircase assemblies is that they are complex to construct, are comprised of a large number of individual components and generally are expensive to manufacture. Most of these prior art assemblies comprise stringers having a normally upper and normally lower stringer member movable longitudinally relative to each other, the upper and lower members being pivotally connected to spacing members which serve as braces in a truss-like configuration.

It is an aim of the present invention to overcome or alleviate the problems of prior art adjustable staircase assemblies and to provide a simple, easily assembled and inexpensive staircase assembly.

According to one aspect of the invention there is provided a stringer for an adjustable staircase assembly comprising a member having a normally upright face with a plurality of spaced pivot connections adjacent one edge thereof and a plurality of locating means to locate stair treads at a predetermined angle relative to said stringer, said locating means being spaced along an arc subtending from said pivot connections.

Preferably said stringer members comprise at least one normally upright face and at least one reinforcing web.

Preferably said stringer members comprise a channel member.

Preferably said pivot connections comprise first apertures in said normally upright face.

Preferably said locating means comprise second apertures in said normally upright face.

According to another aspect of the invention there is provided an adjustable staircase assembly comprising at least two stringer members as hereinbefore defined and a plurality of tread support means pivotally associated with respective said pivot connections and adjustably associated with respective said locating means whereby stair treads may be located between said stringer members at a predetermined angle thereto.

Preferably said tread support means is formed integrally with said stair treads.

Preferably said tread support means comprises a support bracket.

Preferably said tread support means includes a first protrusion for engagement in said first aperture.

Preferably said tread support means includes a second protrusion for engagement in said second aperture.

According to a further aspect of the invention there is provided a kit of parts for an adjustable staircase assembly comprising a pair of stringer members as hereinbefore defined;

a plurality of stair treads; and, mounting means for pivotal attachment of the upper ends of said stringer members to a structure.

A preferred embodiment of the invention will now be described with reference to the accompanying drawings in which:

FIG. 1 illustrates an upper end of a stringer member.

Figure 2:
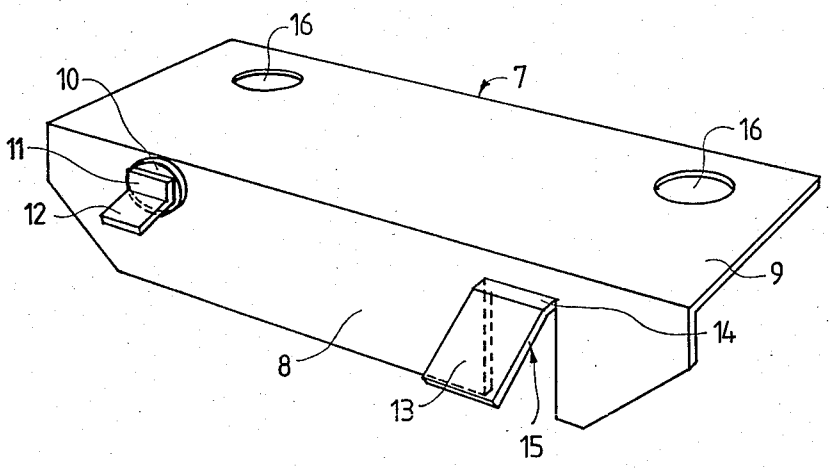

FIG. 2 iilustrates a tread support bracket.

Figure 3A:
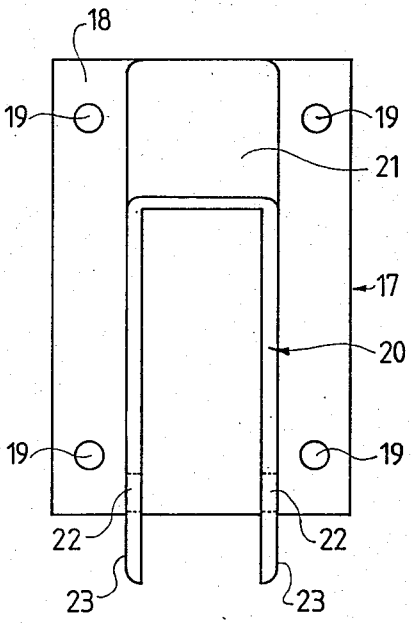
Figure 3:
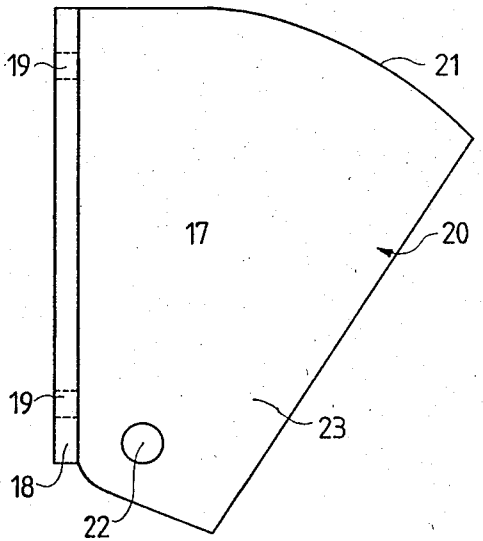

FIGS. 3 and 3A illustrate an upper stringer mounting bracket.

FIG. 4 i11ustrates a cross section along line A—A through the stringer member of FIG. 1 and an attached tread support bracket.

In FIG. 1 the stringer member 1 is comprised of a C-section channel (as shown in FIG. 4) and, preferably comprises a standard galvanized steel purlin member. FIG. 1 shows the normally inner face of the stringer member.

The upper end 2 of the stringer 1 is cut to subtend an angle $\alpha$ of 114° to the lower edge of the stringer. The top corner 3 is cut to provide an angle $\beta$ of 90°. An aperture 4 is formed in the stringer wall to enable connection of the stringer to a mounting bracket (not shown).

A further aperture 5 is formed adjacent a normally lower edge of the stringer 1 and a plurality of slotted apertures 6 are spaced radially along an arc having its origin at the centre of aperture 5. Similar arrays of apertures 5 and 6 are arranged equidistantly over the length of the stringer member.

FIG. 2 shows a tread support bracket 7 comprised of a galvanized steel angle section having an upright web 8 and a transverse web 9. On the upright web 8 is mounted a circular boss 10 having a diameter slightly smaller than the diameter of apertures 5 in the stringer members. On the outer surface of boss 10 is a steel tab 11 having its free end 12 bent outwardly at an angle of about 60°-70° to web 8.

Adjacent the opposite end of web 8 is a further steel tab 13 formed by parallel slits in web 8. The tab 13 has a transverse portion 14 at 90° to web 8 and extends outwardly for a distance corresponding with the thickness of the main or upright web of the stringer 1. Tab 13 also has a free end 15 formed at an angle of 60°-70° to web 8. Elongate tread mounting apertures 16 are formed in transverse web 9.

FIGS. 3 and 3A respectively show a side elevation and front elevation of an upper stringer mounting bracket 17. In FIG. 3 the bracket 17 comprises a mounting plate 18 with mounting apertures 19 formed therein. Extending from the mounting plate 18 is a nose portion 20 having a curved upper surface 21 which has a radius originating from the centre of stringer mounting aperture 22 formed in the side walls 23 of nose portion. FIG. 3A shows a front elevation of the mounting bracket. The dimensions of the nose portion 20 are such that it is a neat fit within the cavity of the C-shaped channel members and enables a pivotal movement between the stringers and brackets when assembled.

Assembly of a staircase according to the invention will now be described with reference to FIG. 4.

Stringer mounting brackets are secured to a wall surface or other suitable structural member adjacent the lower portion of a doorway by bolts, screws, masonry anchors or the like. The brackets may be mounted below the level of the floor surface accessible by the door such that the first tread of the staircase is below the floor surface. Alternatively the brackets may be mounted on either side of the door opening and above the floor such that the first tread is at the same level as the floor.

Stringer members 1 are then pivotally attached to the brackets by bolts extending through apertures 4 in the stringers and apertures 22 in the brackets. The stringers are arranged with the channel openings facing outwardly from the centre of the staircase. The length of the stringers (and thus the inclination of the staircase assembly) will have been predetermined by a number of factors discussed later. Having positioned or mounted the lower ends of the stringer members on a ground surface base or other lower mounting means, tread supports 7 are then installed.

Installation is effected by inserting boss 10 and tab 11 through aperture 5 and tab 13 through an appropriate aperture 6 to give a level tread support surface. The outwardly extending tab portions 12 and 15 are then bent down by hammering or the like to lie against the upright web of the stringer as shown in FIG. 4. This procedure is repeated on each of the opposed arrays of apertures 5 and 6 and stair treads 24 of timber, steel, aluminium, concrete or the like are then bolted to transverse web portions 9 via apertures 16 as shown in phantom in FIG. 4. After assembly, an infil portion such as a sheet metal member may be clipped over the outwardly facing aperture in the channel member for weather protection and/or decorative purposes.

The adjustable staircase assembly according to the invention is suitable for use in situations wherein the staircase inclination is constrained by available space. Where there are no such space constraints, the invention enables a choice of tread rise heights from a predetermined normally suitable range.

The stringer assembly of the invention suitably comprises a standard C17516 galvanized steel C section purlin having an upright web dimension of 175 mm and a transverse web dimension of 55 mm. The section is rolled from 16 gauge mild steel. The ends of the stringer are sawn to shape and the apertures are formed by die punching or any other suitable method. For the majority of applications, the apertures 5 are spaced along the stringer at, say, 308 mm centres and apertures 6 are arranged radially at 12 mm centres along an arc having a 130 mm radius originating from the centre of apertures 5. The spacing of apertures 6 gives a range of tread rise heights between 146 mm and 206 mm. Thus the length of the stringers required may be calculated by dividing the overall elevation of the staircase by the desired tread height to obtain an integer value. This value then corresponds to the number of aperture arrays 5, 6 required in the stringer which may then be cut to a suitable length if necessary.

The lower mounting arrangement of the constructed staircase assembly may comprise any of a number of suitable means. The lower ends of the stringers may simply be cast into a concrete base or they may be cut at an appropriate angle and mounted to an existing base by say angle brackets, bolts and masonry anchors. If required, special base mounts may be fabricated to suit particular requirements.

The present invention provides a staircase assembly which is light in weight, sturdy in construction and is easily assembled without skilled labour. Tests conducted on a staircase constructed as above according to the invention, and having 1 meter wide steps, show that a load of greater than 2 tonnes may be supported without collapse. The present invention is particularly suitable for sale as a kit of parts for the home handyman.

It will be readily apparent to a skilled addressee that many modifications and variations may be made to the invention without departing from the spirit and scope thereof.

I claim:

1. An adjustable stairway assembly, when assembled, comprising a pair of spaced parallel stringers, a plurality of tread support brackets evenly spaced at intervals along the length of said stringers, tread members extending between said stringers and being supported by said support brackets and mounting brackets for pivotally mounting the upper ends of said stringers to an elevated surface, said stringers each comprising a C section channel member having an outwardly facing channel and an inwardly facing upright wall, each said upright wall having a plurality of respectively opposed circular apertures adjacent a lower edge of said wall and equally spaced along said lower edge at distances to define in an erected stairway the vertical separation between adjacent steps, a radial array of slotted apertures in said wall associated with each said circular aperture, each said tread support bracket having an upright wall surface and a horizontally inwardly extending tread support surface, said tread support bracket having adjacent a first end of said upright wall surface a cylindrical boss extending therefrom with a tab connected to and extending from an exposed end of said boss is a direction normal to said upright wall surface, said tread support bracket including a further outwardly extending tab adjacent a second end of said upright wall surface whereby each said tread support bracket is pivotally locatable on said stringer by locating said cylindrical boss in said cylindrical aperture and each said tread support bracket is fixed in a desired horizontal position by locating said further tab in a selected one of said radial array of slotted apertures and said tab and said further tab are bent downwardly to fix said tread support bracket in place, said upper tread support surfaces including apertures to facilitate bolting of tread members thereto.

2. An adjustable stairway as claimed in claim 1 wherein said mounting brackets each comprise a mounting flange and an outwardly extending nose portion, said nose portion having spaced side walls and an arcuate top wall, said arcuate top wall having a radius of curvature originating from the center of an aperture located towards a lower rear edge of said nose portion, said aperture providing means for pivotal connection between said mounting brackets and respective stringers, said nose portion extending into the hollow channel of a respective stringer to provide a substantially continuous top surface for each stringer.

3. An adjustable stairway as claimed in claim 2 wherein the upper end of each stringer includes an upright edge and a horizontal edge, said upright edge being longer than said horizontal edge and each of said upright and horizontal edges being formed with an included angle of about 114 degrees between respective upper and lower edges of said stringers.

4. An adjustable stairway as claimed in claim 1 wherein the C section channel member is steel.

5. An adjustable stairway as claimed in claim 1 wherein the boss and further tab are affixed to the tread support bracket.

* * * * *